US005375913A

United States Patent [19]

Blanchard

[11] Patent Number: 5,375,913

[45] Date of Patent: Dec. 27, 1994

[54] LIFT DEVICE FOR WHEELCHAIRS

[76] Inventor: James E. Blanchard, 970 Valencia St. No. 1, Costa Mesa, Calif. 92626-5742

[21] Appl. No.: 34,563

[22] Filed: Mar. 19, 1993

[51] Int. Cl.[5] ..... A61G 5/00

[52] U.S. Cl. ..... 297/330; 297/310; 297/DIG. 4; 297/DIG. 10

[58] Field of Search ..... 297/330, DIG. 4, DIG. 10, 297/310, 326, 328, 313, 337; 280/242.1

[56] References Cited

U.S. PATENT DOCUMENTS

| | | | |
|---|---|---|---|
| 2,869,623 | 1/1959 | Poulin | 297/DIG. 10 X |
| 3,023,048 | 2/1962 | Barton | 297/DIG. 10 X |
| 3,964,786 | 6/1976 | Mashuda | 297/DIG. 10 X |
| 4,249,774 | 2/1981 | Andreasson | 297/DIG. 10 X |
| 4,390,076 | 6/1983 | Wier et al. | 297/DIG. 10 X |
| 4,456,086 | 6/1984 | Wier et al. | 297/DIG. 10 X |
| 4,773,494 | 9/1988 | Anderson | 297/DIG. 4 X |
| 5,203,610 | 4/1993 | Miller | 297/DIG. 4 X |

*Primary Examiner*—Peter R. Brown
*Attorney, Agent, or Firm*—Poms, Smith, Lande & Rose

[57] ABSTRACT

A power lifting device to attach to a conventional wheelchair (12) includes a lift seat (10) positioned on seat rails of the wheelchair and a tray attached to the runners of the wheelchair below the wheelchair seat rails and stabilized by a stabilizing wheel (6) to hold a power source (15) and (16) and a hydraulic cylinder (17). A hinge (9) on each side of the lift seat enables the back of the lift seat (10) to be raised by a piston of the hydraulic cylinder (17) activated by the power source when a switch (13) is engaged. The power lifting device moves an occupant from a seated position to a substantially upright position enabling the occupant to be moved by a second person with a minimum of lifting by the second person.

9 Claims, 6 Drawing Sheets

LIFT DEVICE FOR WHEELCHAIRS

BACKGROUND

1. Field of the Invention

This invention attached to a conventional wheelchair assists in the transfer of health care facility patients in and out of wheelchairs and in and out of bed. Wheelchairs equipped with the Lift Device for wheelchairs are also useful for elderly and handicapped people in their homes. Health care professionals, such as nurses, find the Lift Devise for Wheelchairs reduces the strain of lifting when transferring patients.

2. Description of Prior Art

Hospitals and Convalescent Care centers use wheelchairs that are stressful both to the patient in the wheelchairs and to the nurses or persons doing the lifting of the patients being transferred. These transfers from the conventional wheelchair can be dangerous to the nurses or persons doing the transfers as well as being dangerous to the patients. The health care personnel has to do all the lifting and guiding of the patient which causes back injures to the person doing the lifting. There is a possibility that the patient might be dropped injuring both the patient and the person doing the transferring. Improvements in conventional wheelchairs are insufficient.

Several types of lift device chairs have been granted patents:

U.S. Pat. No. 4,929,022 inventor:(Geraci)-1990. This chair has a lift apparatus requiring physical strength and effort from the occupant in the chair. Generally, people in wheelchairs do not have the strength required to operate this chair and will not work with paraplegics or quadriplegics. The power for the lifting action is the physical strength of the occupant of the wheelchair. The scissor action of this wheelchair could cause injury to occupant of this chair in open space on the arms of chair.

U.S. Pat. No. 4,948,156 inventor:(Fortner)-1990. This is a standing lift and support for wheelchair user. The frame of this chair is not self contained within the wheelchair. Occupant of this chair must be semi-mobile to put the sling on. Once the occupant is standing up the occupant must bend down to disconnect frame from chair. Many wheelchair users are not stable enough to go though all of the procedures involved in this chair. This chair also requires a turning crank which requires physical effort.

U.S. Pat. No. 4,545,616 inventor:(Booth)-1985. The seat motion of-this chair raises the occupant up to eye level with another standing person which provides confidence of the patient but does not help the occupant to move out of the chair. Nor does this chair help medical personnel transfer patient from chair to other destination.

U.S. Pat. No. 4,067,249 inventor:(Deucher)-1978. This chair is potentially dangerous when the footrest is removed as there is nothing to stabilize the chair when it is in erect position. The back block can cause discomfort for the occupant of the chair. Most people with restricted mobility would have difficulty operating this chair.

U.S. Pat. No. 4,809,804 inventor:(Houston et al)-1978. This chair is a combination wheelchair and walker apparatus. It is not a walker but rather a vertical motorized wheelchair. The metal plate at the footrest location prevents it from being a walker.

OBJECTS AND ADVANTAGES

Besides the objectives and advantages of the Lift Device for Wheelchairs described in my above patent, several objects and advantages of the present invention are:

(a) The Lift Device for Wheelchairs is designed to assist care givers in lifting and transferring of patients.

(b) The Lift Device for Wheelchairs is very convenient for both care givers and patients, more so than conventional wheelchairs presently used.

(c) The Lift Device for Wheelchairs prevents injuries to care givers' backs because the Lift Device for Wheelchairs does the lifting of patients rather than being lifted by the care givers.

(d) The Lift Device for Wheelchairs eliminates the possibility of injury to patients by reducing chances of care givers dropping patients.

(e) The safety features of the Lift Device for Wheelchairs will reduce injuries both to patients and care givers which will reduce lawsuits and decrease Workmen's Compensation and Public Liability insurance premiums.

(f) The Lift Device for Wheelchairs has safety arm rests to insure that hands or fingers will not be injured while Lift Device for Wheelchairs is lifting the patient.

(g) The Lift Device for Wheelchairs reduces the apprehension caused by patients' fear of being dropped and care givers' fear of dropping the patients.

(h) The Lift Device for Wheelchairs also provides the same safety features for home care patients as well as those patients in health care facilities.

(i) The Lift Device for Wheelchairs can be independently operated by semi mobile patients to move freely about his/her surroundings because the Lift Device for Wheelchairs puts such a person in a standing position.

(j) The Lift Device for Wheelchairs can be used as therapy to strengthen circulation in dysfunctional limbs.

(k) Convalescent patient's are prone to having calcium deficiencies which can cause bone fractures in transfers made with conventional wheelchairs. Transfers made with the Lift Device for Wheelchairs reduces the possibility of such bone fractures.

(l) Elderly people have thin skin which can tear very easily in transfers made with conventional wheelchairs. Transfers made with the Lift Device for Wheelchairs reduces the possibility of such skin tears occurring.

DRAWING FIGURES

REFERENCE NUMERALS IN DRAWINGS

Figure 1:
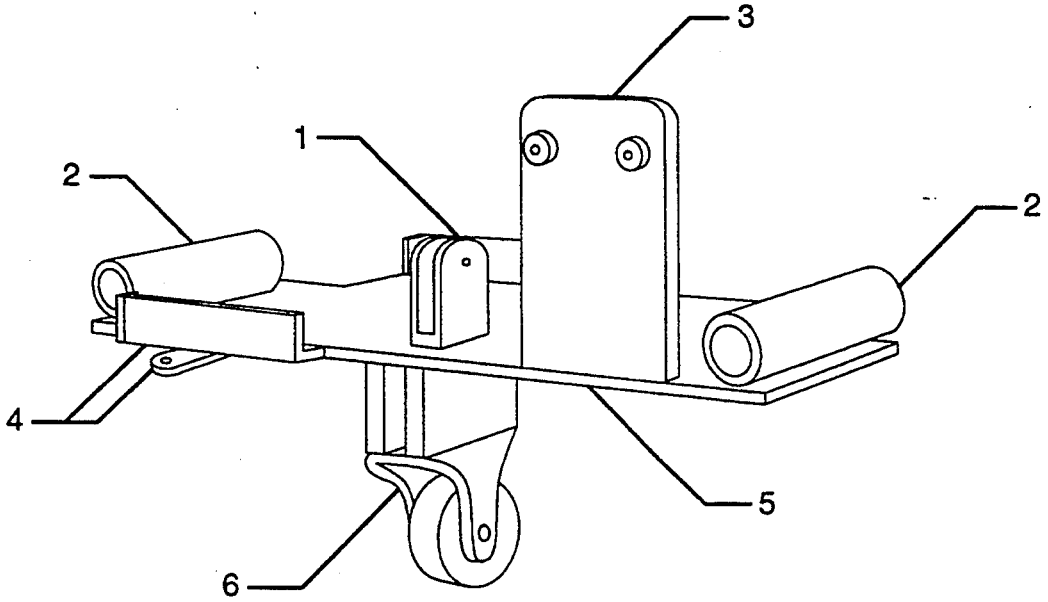
FIG. 1 shows the metal tray that is attached to the wheelchair runners and such tray holds the components of the power source for lifting the seat.

1 Clevis to attach hydraulic cylinder
2 Sleeve to attach to wheelchair runner
3 Motor, pump and reservoir mounting plate
4 Battery bracket and battery strap anchor
5 Bottom plate
6 Stabilizing wheel
7 Pivoting hinge sleeve
8 Back metal rod
9 Side seat hinge
10 Seat
11 Stabilizing cushion
12 Wheelchair
13 Switch
14 Arm rest guard
15 Battery
16 Motor, pump and reservoir
17 Hydraulic cylinder
18 Leg slots
19 Opening for cylinder
20 Aluminum housing

DESCRIPTION-FIGURES 1 to 6

The Lift Device for Wheelchairs will raise occupants of a wheelchair to almost a full standing position with a minimum of lifting assistance. It will also lower occupants to a setting position in the wheelchair again with a minimum of assistance. Wheelchairs equipped with The Lift Device for Wheelchairs is used the same as the standard wheelchair except for the added feature of the seat raising and lowering.

The Lift Device for Wheelchairs has a metal tray as shown in FIG. 1. The metal tray is connected to the back runners of the wheelchair by the way of sleeves 2 attached to each end of the bottom plate 5 of the metal tray. This metal tray holds the components of the power source. A battery bracket and battery strap anchors 4 holds the battery 15 on the metal tray. The lower end of the hydraulic cylinder 17 is attached to the metal tray by way of a clevis 1 attached to the bottom plate 5 of the metal tray. The motor, pump and reservoir 16 are attached to the mounting plate 3 which is attached to the back of the bottom plate 5 of the metal tray. A stabilizing wheel 6 is attached to under side of the bottom plate 5 of the metal tray to give it more stability.

Figure 3:
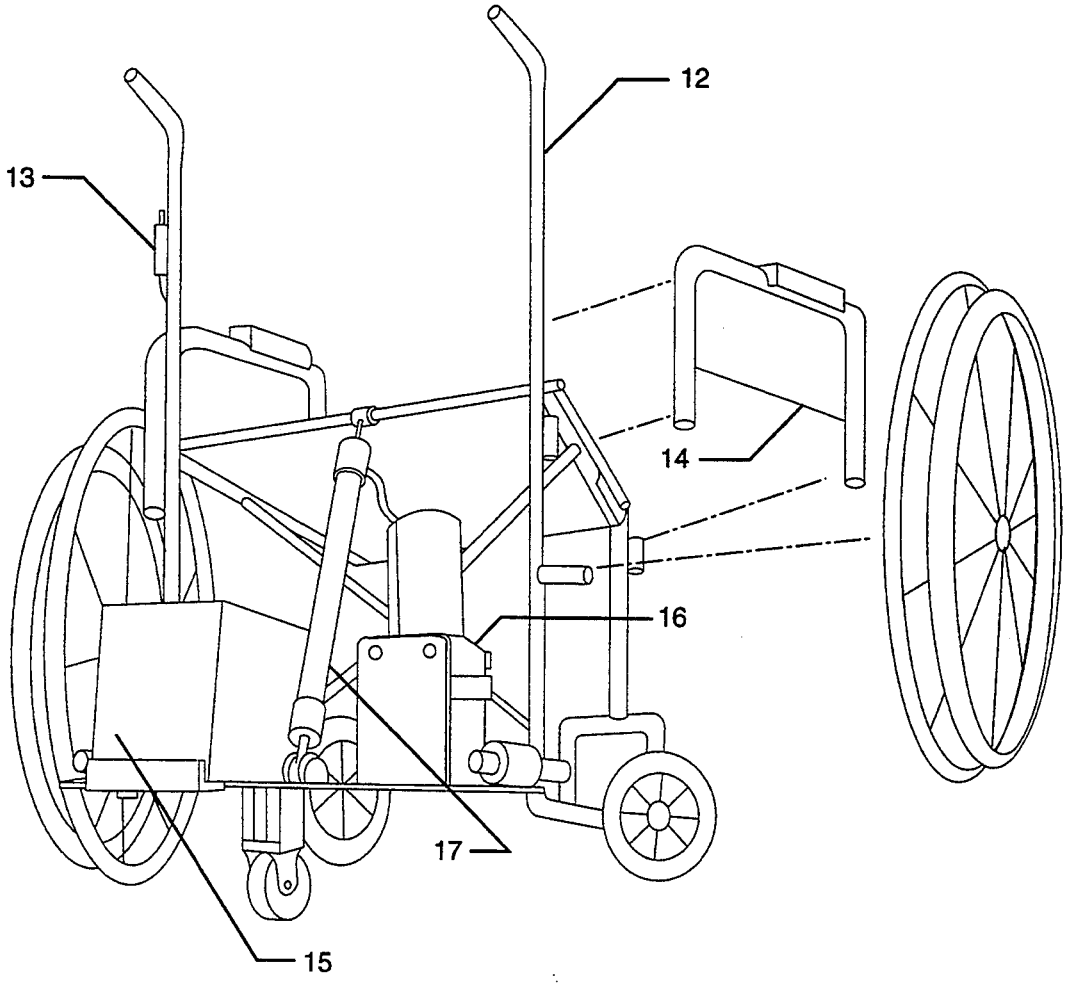
FIG. 3 shows the invention components attached to the wheelchair with the seat in a down position.
Figure 4:
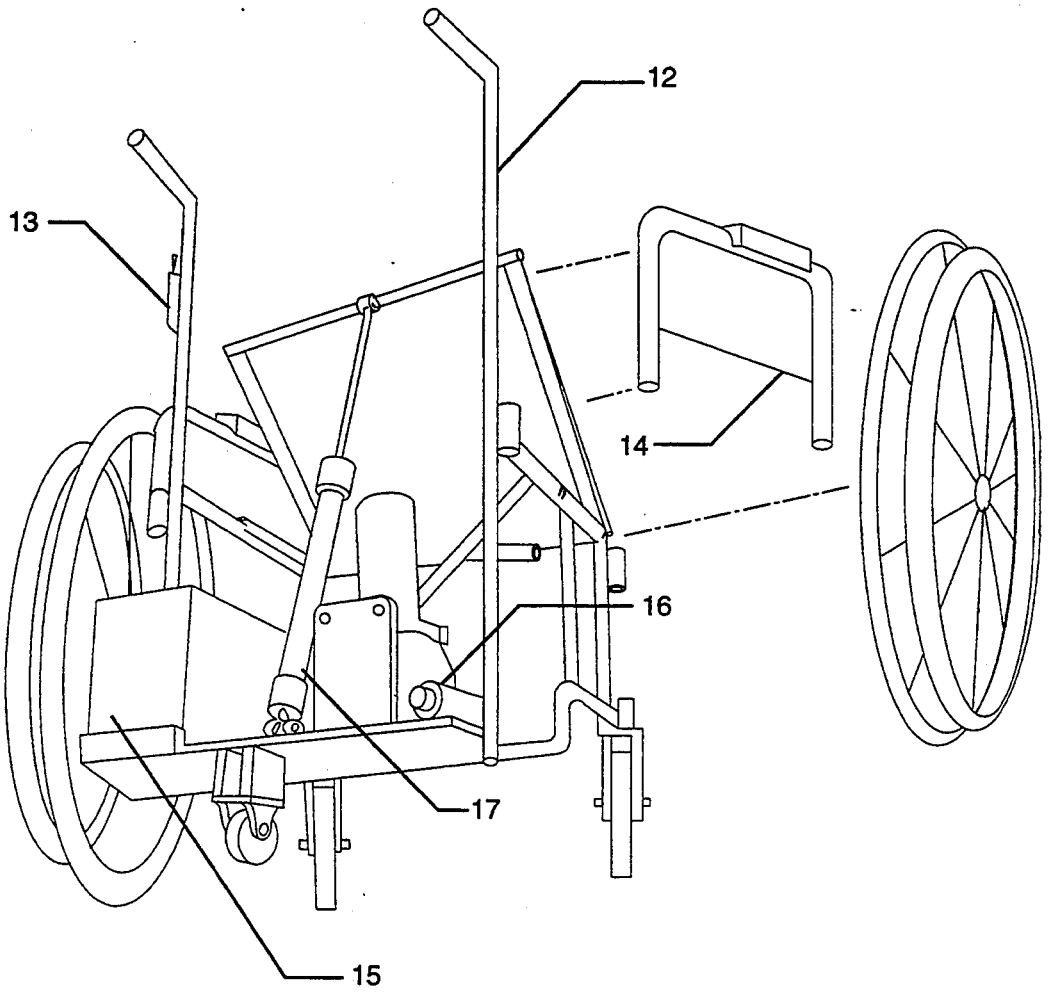
FIG. 4 shows the invention components attached to the wheelchair with the seat in a raised position.

The power source components are shown in FIGS. 3 and 4 and consist of a battery 15, a electric motor, a pump, reservoir 16 and a hydraulic cylinder 17.

Figure 2:
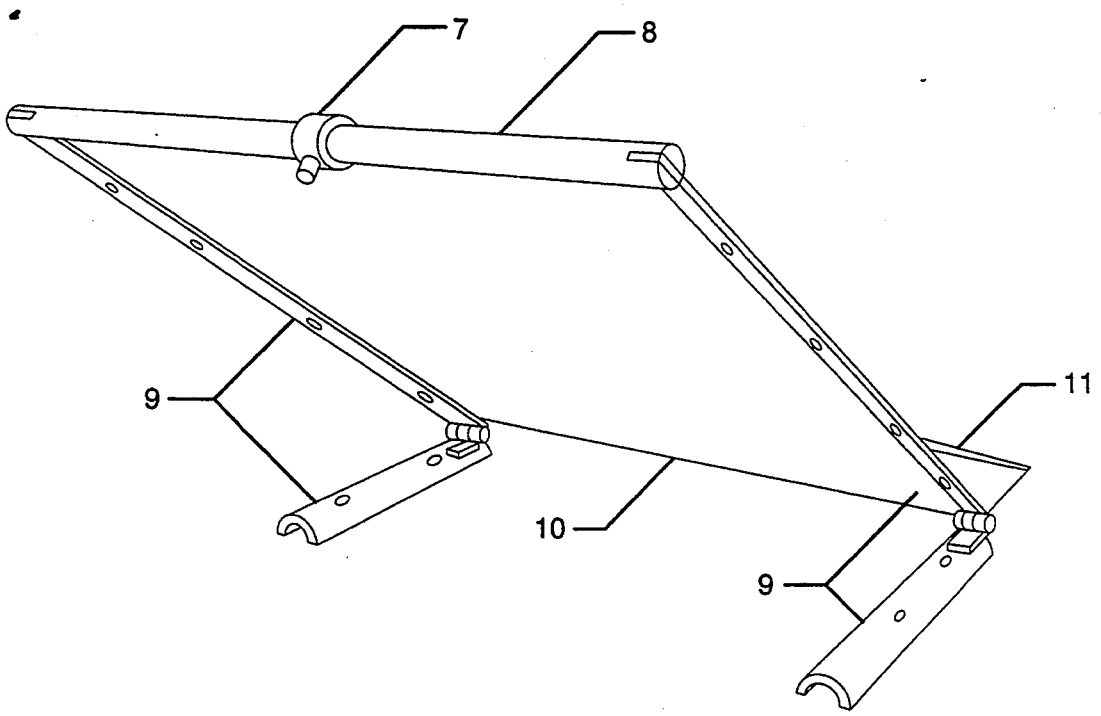
FIG. 2 shows the lift seat apparatus.
Figure 5:
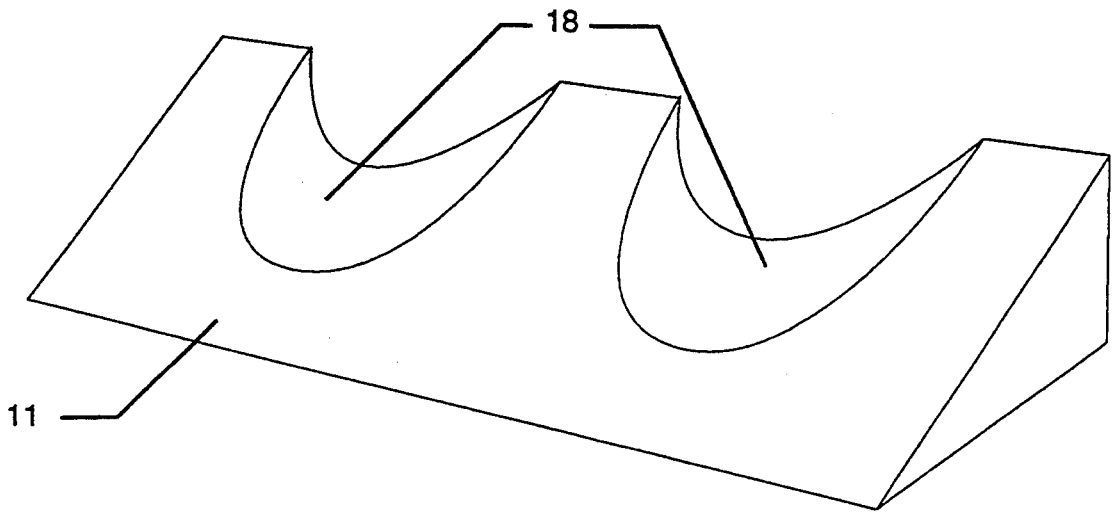
FIG. 5 shows the seat cushion to stabilize the patient during the raising process.

The lift seat apparatus is shown in FIG. 2. The piston of the hydraulic cylinder 17 is connected to the back metal rod 8 of the lift seat apparatus by the way of a pivoting hinge sleeve 7 that slides over the back metal rod e of the seat apparatus. Both the right and left sides of the seat 10 are attached to the top of the right and left metal hinges 9. The bottom of the seat hinges 9 are attached to seat rails of the wheelchair. A stabilizing cushion 11 is a part of the bottom of wheelchair seat to stabilize an occupant of the wheelchair while the lift seat apparatus is being raised or lowered and is shown in FIG. 5. The stabilizing cushion 11 has leg slots 18 for the comfort of the occupant of the wheelchair.

FIG. 3 shows the Lift Devise for Wheelchairs attached to a wheelchair 12 with the seat in a lowered position while FIG. 4 shows the seat in a raised position. A switch 13 is used to activate the Lift Devise for Wheelchairs for lifting and lowering action. The Lift Device for Wheelchairs have arm rest guards 14 going from the top to the bottom of each arm rest to protect the occupant from injury when the seat is raised or lowered.

Figure 6:
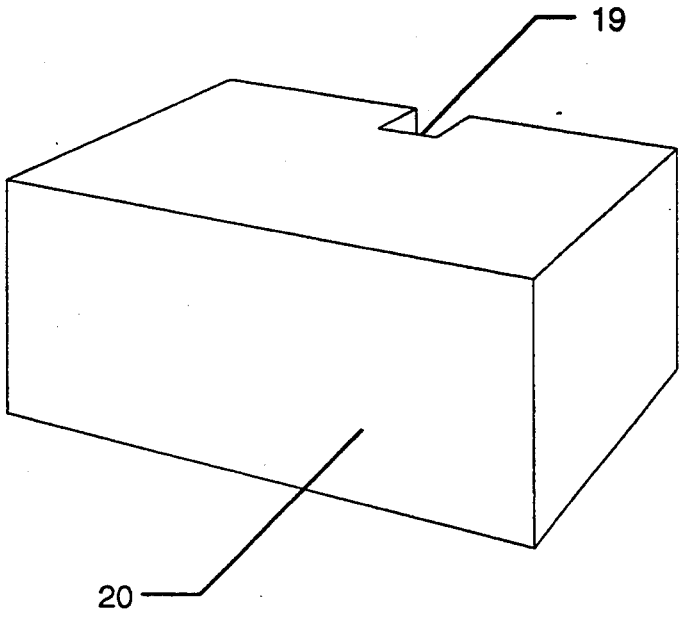
FIG. 6 shows the aluminum housing for the power source.

FIG. 6 shows the aluminum housing 20 that incases the power unit to protect it from spills or external contaminants. The aluminum housing 20 has an opening for the hydraulic cylinder 19 on the top and front of the incasing unit.

Thus the reader will see that the Lift Devise for Wheelchairs provides the means for an occupant of a wheelchair with impaired mobility to be raised to almost to a full standing position with a minimum of lifting effort on the part of a second person. This will allow the second person to safely guide the occupant to a bed or other desired location without injury to the assisting person. Conversely it will allow guiding the impaired mobility person into a wheelchair with the same advantages as guiding the person out of the wheelchair. Due to the safety features moving a person in and out of the wheelchair will be less stressful to both the impaired mobility person and the person doing the guiding. Public liability and workmen's compensation insurance premiums will be appreciable reduced for care giving facilities. The Lifting devise for Wheelchairs can assist persons with partially impaired mobility to be able to get in and out of the wheelchair without assistance from a second person.

While my above description contains many specificities, these should not be construed as limitations on the scope of the invention, but rather as an exemplification of one preferred embodiment thereof. Many other variations are possible. For example the power source could consist of a manual foot pump, the cylinder could be powered by air pressure, the motor could be powered by building electrical current instead a battery power, the gel-cell battery could be replaced with a dry cell battery. The cylinder placement could be modified and scissor hinges used on the seat to give varied lifting action.

Accordingly, the scope of the invention should be determined not by the embodiments illustrated, but by the appended claims and their legal equivalents.

I claim:

1. A powered lifting device incorporated on a conventional wheelchair having a pair of wheelchair seat rails and a pair of wheelchair back runners, said lifting device comprising:

a lift seat having a front edge and having two side edges with a back rod therebetween, said lift seat having hinge means for replaceably mounting said lift seat on said wheelchair seat rails;

a rigid tray mounted on said wheelchair back runners below said lift seat said tray having a stabilizing wheel mounted to a lower surface of said tray; lifting means attached to said lift seat and having two ends, one end connected to said lift seat back rod and the other end mounted on an upper surface of said tray; and a power source mounted on said tray for actuating said lifting means.

2. The lifting device of claim 1 wherein said power source comprises an electric motor, a hydraulic pump adjacent to and driven by said electric motor, and a hydraulic fluid reservoir communicating with said hydraulic pump.

3. The lifting device of claim 2 wherein said electric motor is powered by a battery.

4. The lifting device of claim 2 wherein said lifting means is connected to said power source by means of flexible tubing and comprises a hydraulic cylinder having a bottom component thereof attached to said rigid tray and a piston component connected to said back rod of said lift seat.

5. The lifting device of claim 4 wherein said piston component is connected to said lift seat by a pivoting hinge sleeve.

6. The lifting device of claim 1 wherein said power source is controlled by a double action spring loaded switch.

7. The lifting device of claim 1 wherein said hinge means comprises a pair of hinges, each hinge comprising a first straight member of flat rigid material disposed along the full length of respective ones of said lift seat side edges, and a second straight member of arcuate cross-section rigid material curved about a longitudinal axis thereof, said second straight member being swivellably connected to said first straight member adjacent said front edge of said lift seat, each said second straight member being mounted to and following the contour of respective ones of said wheelchair seat rails.

8. The lifting device of claim 7 wherein said rigid material of said first and second straight members is steel.

9. The lifting device of claim 1 wherein said lift seat further comprises a stabilizing cushion mounted on the upper surface of said lift seat and having leg slots formed therein to facilitate stable transfer of an occupant of said wheelchair.

* * * * *